United States Patent [19]

Bertens

[11] 4,350,920

[45] Sep. 21, 1982

[54] DISPENSER CATHODE

[75] Inventor: Theodorus C. J. M. Bertens, Eindhoven, Netherlands

[73] Assignee: U.S. Philips Corporation, New York, N.Y.

[21] Appl. No.: 165,893

[22] Filed: Jul. 3, 1980

[30] Foreign Application Priority Data

Jul. 17, 1979 [NL] Netherlands ..... 7905542

[51] Int. Cl.[3] ..... H01J 1/14; H01J 19/06; H01K 1/04

[52] U.S. Cl. ..... 313/346 R; 252/521; 313/337

[58] Field of Search ..... 313/346, 337, 311; 252/521

[56] References Cited

U.S. PATENT DOCUMENTS

| | | | |
|---|---|---|---|
| 3,358,178 | 12/1967 | Figner et al. | 313/346 R |
| 3,719,856 | 3/1973 | Koppius | 313/311 |
| 3,922,428 | 11/1975 | Cronin | 313/346 R |
| 4,007,393 | 2/1977 | Van Stratum et al. | 313/346 R |

*Primary Examiner*—Saxfield Chatmon, Jr.
*Attorney, Agent, or Firm*—Robert J. Kraus

[57] ABSTRACT

A compressed dispenser cathode having 1–15% by weight of $Ba_2Sc_2O_5$ in a porous metal cathode body has an emission having a larger current density (exceeding 6 A/cm$^2$) and a longer life (more than 3000 hours).

4 Claims, 5 Drawing Figures

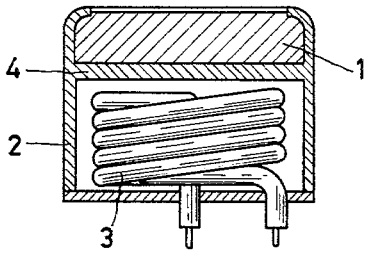
FIG.1
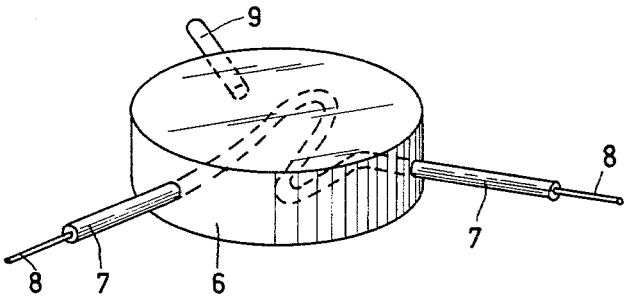
FIG.2
| I | II | III |
|---|---|---|
| W 70 – 95 % | W | W 85 – 99 % |
| $Ba_3 Sc_4 O_9$ 5 – 30 % | BaO 65 %<br>CaO 17,5 %<br>$Al_2O_3$ 14,5 %<br>$Sc_2O_3$ 3 % | $Ba_2 Sc_2 O_5$ 1 – 15 % |
| 1,5–4 A/cm$^2$<br>1100°c<br>2000–3000h | 5 A/cm$^2$<br>1000°c<br>3000h | > 6 A/cm$^2$<br>1000°c<br>> 3000h |
FIG.3

| | I | | | II | |
|---|---|---|---|---|---|
| | $Ba_3Sc_4O_9$ | $Ba_2Sc_2O_5$ | | $Ba_3Sc_4O_9$ | $Ba_2Sc_2O_5$ |
| °C | $A/cm^2$ | $A/cm^2$ | | $A/cm^2$ | $A/cm^2$ |
| 1000° | 5.0 | 7.5 | | 30 | 53 |
| 950° | 3.5 | 7.5 | | 21 | 40 |
| 900° | 2.0 | 6.0 | | 13 | 30 |

FIG.5

DISPENSER CATHODE

BACKGROUND OF THE INVENTION

The invention relates to a dispenser cathode comprising a heating element and a porous metal cathode body having in its pores a material for dispensing barium, barium oxide and scandium oxide.

Such cathodes are used, for example, in pickup tubes and picture display tubes, transmitter tubes, klystrons and travelling wave tubes.

Such a dispenser cathode is disclosed in U.S. Pat. No. 3,358,178. This patent describes a compressed dispenser cathode body composed of tungsten powder and $Ba_3Sc_4O_9$. The $Ba_3Sc_4O_9$ constitutes from 5 to 30% of the overall weight of the cathode body. Such a cathode is capable of emitting current at a density of 1.5 -4 A/cm$^2$ at 1000°-1100° C. for a few thousand hours. However, there exists a need for cathodes having a longer life and better emission.

U.S. Pat. No. 4,007,393 discloses an impregnated dispenser cathode having as dispensing compounds BaO, CaO, $Al_2O_3$ and $Sc_2O_3$. This cathode can provide a current density of 5 A/cm$^2$ at 1000° C. for approximately 3000 hours.

SUMMARY OF THE INVENTION

It is an object of the invention to provide a readily reproducible dispenser cathode which can provide an even greater current density at 1000° C. and at lower temperatures, with a still longer life.

Another object of the invention is to provide a compact dispenser cathode having a small thermal capacity as described in French Patent Specification No. 1,288,133, which can be manufactured with small dimensions and is suitable for use in television camera tubes.

A dispenser cathode of the kind described in the opening paragraph is characterized according to the invention in that the material in the pores consists essentially of $Ba_2Sc_2O_5$ which constitutes 1-15% by weight of the cathode body, and is composed of 68-72% by weight of BaO and 32-28% by weight of $Sc_2O_3$.

In the article "Compounds in the system $BaOSc_2O_3$", Mat.Res.Bull, Vol. 9, pp. 1623-1630, 1974, it is stated, that compounds of BaO and $Sc_2O_3$ and compounds of BaO and $Y_2O_3$ may be of interest as emission-active substances in thermal cathodes. However, it is surprising that with 1-15% by weight of pure $Ba_2Sc_2O_5$ or $Ba_2Sc_2O_5$ in solid solution with BaO in a W-matrix, cathodes are obtained which are readily reproducible, are capable of producing a very large emission current density (exceeding 6 A/cm$^2$) and have a very long life. An additional advantage is that less scandium oxide is necessary than in the known dispenser cathode having $Ba_3Sc_4O_9$ and the cathodes are less expensive. This article indicates from experiments in which different ratios of BaO and $Sc_2O_3$ were mixed and sintered at a number of temperatures and in which the resulting compounds were subjected to X-ray analysis, that in addition to the known barium scandates $Ba_3Sc_4O_9$ and Ba $Sc_2O_4$ the compounds $Ba_2Sc_2O_5$ and $Ba_6Sc_6O_{15}$ must also occur. It also shows with reference to variations in the crystal structure of $Ba_2Sc_2O_5$ that BaO can dissolve to a restricted extent in $Ba_2Sc_2O_5$.

When the dispensing compound for a cathode according to the invention is obtained from a mixture of BaO and $Sc_2O_3$ which contains more than about 68% by weight and less than about 72% by weight of BaO, the stoichiometric excess of BaO dissolves in the $Ba_2Sc_2O_5$ formed. By always using the same quantities of dispensing compound, substantially identical cathodes are obtained. If the BaO did not dissolve in the $Ba_2Sc_2O_5$, it would cause poor reproducibility and would adversely influence the emission properties of the cathode, because BaO is hygroscopic.

The dispenser cathodes can be obtained, for example, as follows:

68-72% by weight of BaO and 32-28% by weight of $Sc_2O_3$ are mixed in a liquid medium, for example hexane, and after evaporating the solvent are fired at 1000° C. for approximately 16 hours. The result is pure $Ba_2Sc_2O_5$ or a solid solution of $Ba_2Sc_2O_5$ and BaO. 3 mg of this substance, in the form of a powder having a particle size which is substantially between 2 μm and 15 μm, are mixed with up to 100 mg of tungsten powder . Cathode bodies are compressed from this mixture at a pressure of $10.10^3$ kg/cm$^2$. The cathode bodies are then sintered for 5 minutes at a temperature of 1500° C. in hydrogen. The emissive surface is then polished in a known manner by means of an $Al_2O_3$ disk. The cathode body is then secured on the upper face of an Mo cathode shaft and a heating element is provided in the shaft.

Such cathodes have been found to have a zero volt emission of, for example. 6.2 A/cm$^2$ at 1000° C. measured on molybdenum. It was found that another cathode of the same batch even had a zero volt emission of 7.5 A/cm$^2$ at 1000° C., which emission decreased only to 6.0 A/cm$^2$ at 900° C. This emission is considerably better than the emission of the cathode described in U.S. Pat. No. 4,007,393.Moreover, the life has been found to be considerably longer than 3000 hours.

BRIEF DESCRIPTION OF THE DRAWING

Embodiments of the invention will now be described in greater detail, by way of example, with reference to the drawing, in which:

FIG. 1 shows a cathode according to the invention,

FIG. 2 shows a cathode of the compact type according to the invention,

FIG. 3 is a table in which the cathode according to the invention is compared with the prior art, FIG. 5 shows in Tables I and II the zero volt emission and the emission at 1000 volts pulse load, at three temperatures, for both $Ba_3Sc_4O_9$ *and* $Ba_2Sc_2O_5$.

DESCRIPTION OF THE PREFERRED EMBODIMENTS

Figure 4:
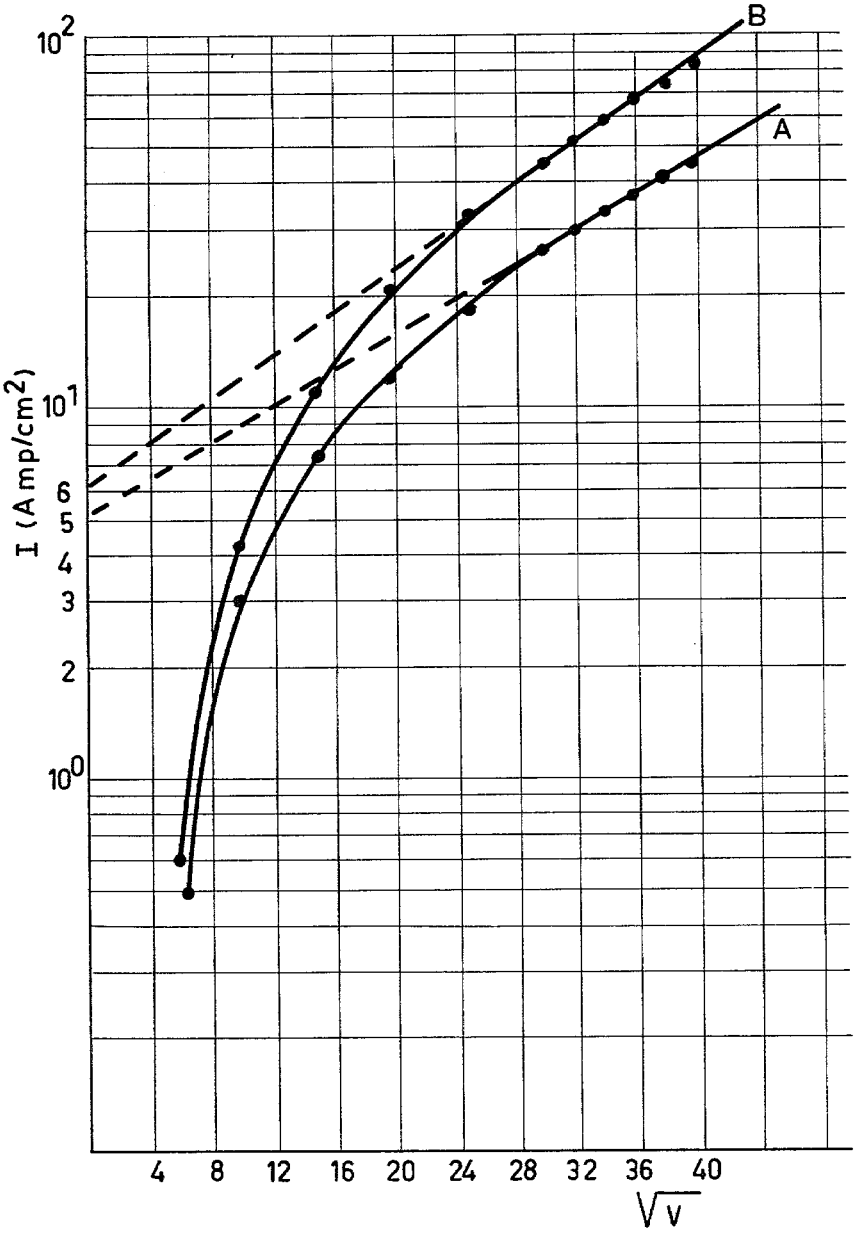
FIG. 4 is a graph in which the emission of a known cathode is compared with that according to the invention.

FIG. 1 shows a cathode according to the invention. The cathode body 1 is surrounded by a molybdenum cylinder 2. A heating element 3 is provided in the cylinder as is a partition 4 consisting of molybdenum, for preventing diffusion of products from the cathode body to the heating element. The cathode body 1 is manufactured in the manner previously described and comprises pure $Ba_2Sc_20_5$ or a solid solution of BaO and $Ba_2Sc_2O_5$ in a tungsten matrix. It will be obvious that other matrix materials may also be used, such as, molybdenum, tantalum, the platinum group and mixtures and/or alloys thereof.

FIG. 2 shows another embodiment of a cathode according to the invention. The cathode body 6 consisting of a tungsten matrix containing $Ba_2Sc_2O_5$ which can have BaO dissolved therein. The cathode body further comprises a heating element 8 covered with an electrically-insulating layer 7 of $Al_2O_3$, and a suspension wire 9. This cathode has a diameter of 0.9 mm and a thickness of 0.45 mm. At 985° C. the cathode operates at a power of 0.39 Watt and warms up in of approximately 3 seconds. Such a cathode is particularly suitable for use in a television camera tube.

FIG. 3 shows in column I the composition of the cathode body in % by weight and the properties (current density, operating temperature and life) of the dispenser cathode disclosed in U.S. Pat. No. 3,358,178. Column II shows the composition in % by weight of the impregnate and properties of the impregnated dispenser cathode disclosed in U.S. Pat. No. 4,007,393. Column III shows the composition of the cathode body in % by weight and the properties of the compressed dispenser cathode according to the invention. It follows from this table that according to the invention a cathode is obtained having a higher current density at 1000° C. and a longer life than the known cathodes. Moreover, the cathodes are readily reproducible, even when they are of a compact construction.

The graph shown in FIG. 4 denotes the emission curve A of a cathode according to the U.S. Pat. No. 4,007,393 as compared with the emission curve B of a cathode according to the invention. The zero volt emissions at 1000° C. Br (brightness) are approximately 5.1 and 6.2 A/cm$^2$, respectively. As is know, the zero volt emission is found by taking the point of intersection of the asymptote of the upper part of the emission curve and the current density axis (log Ampères/cm$^2$). The emission curves show the superiority of the cathodes according to the invention. The points on the emission curves were measured in the usual manner as described, for example, in U.S. Pat. No. 3,719,856.

The table in FIG. 5 shows a number of emission measurements of cathodes having 7% by weight of barium scandate ($Ba_3Sc_4O_9$ and $Ba_2Sc_2O_5$). Table I shows the zero volt emission in A/Cm$^2$ at the three temperatures determined as described in FIG. 4. From this table it appears that both the relative and the absolute decrease of the emission in cathodes with $Ba_2Sc_2O_5$ at lower temperatures is much smaller. An advantage of cathodes with $Ba_2Sc_2O_5$ is that they still have good emission at lower temperatures (for example 900° C.) Table II shows the emission with a pulse load with a field of 1000 V, a value frequently used in practice. In this case the high emission of $Ba_2Sc_2O_5$ cathodes is also striking.

What is claimed is:

1. A dispenser cathode comprising a porous metal body and a heating element for heating the body, said body including an emissive surface and having a material in its pores for dispensing barium, barium oxide and scandium oxide when the cathode is heated, said material consisting essentially of $Ba_2Sc_2O_5$ constituting 1–15% by weight of the body, said material consisting essentially of 68–72% by weight of BaO and 32–28% by weight of $Sc_2O_3$.

2. A dispenser cathode as in claim 1 wherein the heating element comprises a metal core surrounded by an electrically-insulating layer, said heating element being embedded in the body.

3. A dispenser cathode as in claim 2, wherein the body is disc-shaped and has a thickness between 0.3 and 0.5 mm.

4. An electric discharge tube including a dispenser cathode comprising a porous metal body and a heating element for heating the body, said body including an emissive surface and having a material in its pores for dispensing barium, barium oxide and scandium oxide when the cathode is heated, said material consisting essentially of $Ba_2Sc_2O_5$ constituting 1–15% by weight of the body, said material consisting essentially of 68–72% by weight of BaO and 32–28% by weight of $Sc_2O_3$.

* * * * *